US008648283B2

(12) United States Patent
Cho et al.

(10) Patent No.: US 8,648,283 B2
(45) Date of Patent: Feb. 11, 2014

(54) INSULATOR FOR ELECTRIC HEATER AND HEAT ASSEMBLY WITH THE SAME IN WASHING MACHINE

(75) Inventors: Ki Chul Cho, Changwon-shi (KR); Jong Chul Bang, Changwon-shi (KR); Dong Beom Lee, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 2303 days.

(21) Appl. No.: 10/415,493

(22) PCT Filed: Aug. 29, 2002

(86) PCT No.: PCT/KR02/01627

§ 371 (c)(1),
(2), (4) Date: Apr. 30, 2003

(87) PCT Pub. No.: WO03/018899

PCT Pub. Date: Mar. 6, 2003

(65) Prior Publication Data

US 2004/0040947 A1 Mar. 4, 2004

(30) Foreign Application Priority Data

Aug. 31, 2001 (KR) ..... P2001-53340
Aug. 31, 2001 (KR) ..... P2001-53342
Aug. 27, 2002 (KR) ..... P2002-50918

(51) Int. Cl.
*H05B 3/06* (2006.01)

(52) U.S. Cl.
USPC ..... 219/522; 219/532; 219/536

(58) Field of Classification Search
USPC ..... 219/532, 536, 550, 542, 522; 174/138 J, 174/138 R, 175; 34/601, 603
See application file for complete search history.

(56) References Cited

U.S. PATENT DOCUMENTS

| | | | | |
|---|---|---|---|---|
| 3,560,708 | A | 2/1971 | Fox | |
| 3,641,312 | A * | 2/1972 | Ammerman et al. | 219/532 |
| 3,812,322 | A * | 5/1974 | Osterkorn et al. | 219/532 |
| 3,842,244 | A * | 10/1974 | Kelley | 219/550 |
| 3,846,619 | A | 11/1974 | Wightman et al. | |
| 3,860,788 | A | 1/1975 | Staples | |
| 3,883,721 | A | 5/1975 | Paulson et al. | |
| 3,920,887 | A * | 11/1975 | Kloos et al. | 174/148 |
| 4,656,340 | A * | 4/1987 | St. Louis | 219/532 |
| 4,700,495 | A * | 10/1987 | Drews et al. | 34/603 |

(Continued)

FOREIGN PATENT DOCUMENTS

| | | |
|---|---|---|
| JP | 48-58668 | 8/1973 |
| JP | 51-163049 | 12/1976 |

(Continued)

OTHER PUBLICATIONS

Japanese Office Action dated Nov. 15, 2005.

*Primary Examiner* — Henry Yuen
*Assistant Examiner* — Eric Stapleton
(74) *Attorney, Agent, or Firm* — McKenna Long & Aldridge LLP

(57) ABSTRACT

An insulator for an electric heater is configured to allow a heater coil to expand/contract uniformly, and permit an easy fitting of the heater coil thereto. The insulator includes a body part formed of an insulating material, a coil seating part at an end of the body part for supporting the heater coil, and a seating slot between the coil seating part and the body part for inserting the heat coil.

37 Claims, 9 Drawing Sheets

(56) References Cited

U.S. PATENT DOCUMENTS

| | | | | |
|---|---|---|---|---|
| 5,122,640 | A * | 6/1992 | Holmes | 219/532 |
| 5,880,440 | A * | 3/1999 | Whitfield et al. | 219/536 |
| 5,935,471 | A | 8/1999 | St. Louis | |
| 5,954,983 | A * | 9/1999 | Holmes | 219/536 |
| 5,959,254 | A * | 9/1999 | Martin, Sr. | 174/138 J |
| 6,020,577 | A * | 2/2000 | Barker | 219/537 |
| 6,108,940 | A * | 8/2000 | St. Louis | 34/601 |
| 6,222,133 | B1 * | 4/2001 | St. Louis | 174/138 J |
| 6,259,070 | B1 | 7/2001 | Audet | |
| 6,509,554 | B2 * | 1/2003 | Howard et al. | 219/536 |

FOREIGN PATENT DOCUMENTS

| | | |
|---|---|---|
| JP | 57-111982 | 7/1982 |
| JP | 60-2245 | 1/1985 |
| JP | 60-48796 | 3/1985 |
| JP | 06-281181 | 10/1994 |
| JP | 10-235087 | 9/1998 |
| KR | 20-1999-0003194 | 1/1999 |

* cited by examiner

INSULATOR FOR ELECTRIC HEATER AND HEAT ASSEMBLY WITH THE SAME IN WASHING MACHINE

This application is a National Stage Entry of International Application No. PCT/KR02/01627, filed Aug. 29, 2002, and claims the priority benefit of Korean Application No. P2001-0053340 filed on Aug. 31, 2001, Korean Application No. P2001-0053342 filed on Aug. 31, 2001, and Korean Application No. P2002-0050918 filed on Aug. 27, 2002, the contents of each application are hereby incorporated by reference in their entirety.

TECHNICAL FIELD

The present invention relates to an electric heater, and more particularly, to an insulator for supporting a heater coil generating heat, and a heater assembly with the same for use in a combined laundry washing/drying machine.

BACKGROUND ART

An electric heater is activated by an electric supply to heat ambient air, and is used for various purposes. For example, the electric heater is utilized for a laundry dryer or a washing machine having washing and drying functions.

FIG. 1 is a cross sectional view of a conventional combined laundry washing/drying machine, in which a drum-type washing machine having a drying function is shown. The combined laundry washing/drying machine includes a tub 2 supported by a damper 7 and a spring 6 in a body 1 for storing washing water, a washing drum 3 for washing, rinsing and dehydrating the laundry, a motor 4 disposed under the tub 2 for transmitting a rotary force to the washing drum 3, and a pulley and belt 5 disposed between the motor 4 and a drum shaft (not shown) for transmitting the rotary force of the motor 4 to the drum shaft.

The tub 2 is provided at an outward proper position thereof with a blast duct 8 communicated with the washing drum 3. A blast fan 9 compulsorily circulates the air within the blast duct 8, and a heater assembly 10 is disposed at the front of the blast fan 9 to heat the air supplied to the washing drum 3.

With the structure of the combined laundry washing/drying machine as described above, after a series of washing, rinsing and dehydrating processes are completed, the washing drum 3 is rotated at a low speed to uniformly mix the laundry. At that time, a power is supplied to the heater assembly 10 and the blast fan 9, so that the heater assembly 10 generates heat, thereby heating the air. The heated air is circulated within the washing drum 3 and the blast duct 8 to dry the laundry.

FIGS. 2 to 4 show the structure of another conventional heater assembly, in which the heater assembly is enclosed by a housing 11. The housing 11 includes a bottom plate 12, and side plates 13 and 14 vertically extended from both edges of the bottom plate 12. Mounting taps 15 are formed on upper ends of the side plates 13 and 14, and the housing 11 is mounted to the blast duct 8 by the mounting taps 15.

An interior space of the housing 11 is divided into upper and lower halves by a metallic supporting plate 16. The supporting plate 16 is fixed to the side plates 13 and 14, with protruding arms 17 formed at both ends of the supporting plate inserted into penetrating holes of the side plates.

The supporting plate 16 is provided with a heater coil 18 for generating heat by use of electric resistance produced by flowing electric current through the coil. The heater coils 18 are disposed in several rows on upper and lower portions of the supporting plate 16, with the respective heater coils elongated in left and right directions of the supporting plate. The heater coils 18 are electrically connected to each other, and terminals 19 are provided at both ends of the heater coil 18 to supply the power to the heater coil.

The heater coil 18 is supported by an insulator 20 fixed to the supporting plate 16. The insulator 20 is made of insulation material to electrically isolate the heater coil 18 from the supporting plate 16 and support the heater coil against the supporting plate 16. The insulator 20 generally penetrates the supporting plate 16, and has an upper portion protruded upward from the supporting plate 16 and a lower portion protruded downward from the supporting plate, with the portions of the insulator which are upward and downward protruded from the supporting plate are symmetrical to each other.

FIG. 4 shows the structure of the insulator, in which the heater coil 18 is supported by the insulator 20. The insulator 20 of heat insulating material is formed in a plate shape, with an upper end of the insulator being symmetrical to a lower end thereof. Therefore, it will be described on the construction of the upper end only.

The insulator 20 has at both ends parallel notches 21 for mounting the insulator to the supporting plate 16. Also, the insulator 20 has straight slots 22 upwardly and downwardly formed from a center of the upper surface of the insulator. Each of the straight slots 22 has a length equal to the half of the length between the parallel notches. The straight slot 22 is provided at a lower end with a fixing notch 24 for fixing the heater coil 18.

The insulator 20 has at the upper surface thereof inclined guide surfaces 23. The inclined guide surface 23 is to guide a process of insulating the heater coil 18 into the insulator 20. The insulator 20 has lateral notches 25 each formed at both sides thereof. Each of the lateral notches 25 has an inclined angle similar to the inclined guide surface 23. The lateral notch 25 is flush with the fixing notch 24.

It will now be described on the process of insulating the heater coil 18 into the insulator 20 in brief. Adjacent first, second and third convolutions 18*a*, 18*b* and 18*c* of the heater coil 18 are inserted into the fixing notch 24 and two lateral notches 25 of the insulator 20, respectively. Specifically, the first convolution 18*a* is disposed at a position corresponding to the straight slot 22, while the second and third convolutions 18*b* and 18*c* are disposed at the guide surface 23 of the insulator 20, respectively.

Next, the heater coil 18 is pressed, such that the respective convolutions 18*a*, 18*b* and 18*c* is moved in an arrow direction. The respective convolutions 18*a*, 18*b* and 18*c* is guided along the straight slot 22 and the guide surface 23, and is inserted and fixed to the fixing notch 24 and the lateral notches 25.

The respective second and third convolutions 18*b* and 18*c* is deformed in a direction away from the first convolution 18*a* along the guide surface 23, and when it comes in contact with the lateral notch 25, is restored into its original shape to catch the lateral notch.

The conventional heater coil has some problems as follows.

First, the heater coil 18 generates a lot of heat during operation, thereby increasing a temperature of the heater coil, while the heater coil is maintained at a room temperature during no operation. This means the repeated expansion and contraction of the heater coil 18. However, the first, second and third convolutions 18*a*, 18*b* and 18*c* of the heater coil which are secured to the insulator 20 cannot expand and contract, contrary to other portions. The first, second and third convolutions 18*a*, 18*b* and 18*c*, however, receive more thermal stress than other portions of the heater coil receive, so that this phenomenon exerts an advert influence on the heater coil in the strength aspect. In addition, the heat is not uniformly distributed over the total heater coil 18.

Secondly, it is significantly complicate to mount the heater coil 18 to the insulator 20. Specifically, in order to insert the heater coil into the insulator 20, the first, second and third convolutions 18*a*, 18*b* and 18*c* must be inserted into the fixing notch 24 and the lateral notches 25 at the same time. At that time, the elastic direction of the resilience second 18*b* is counter to that of the third convolution 18*c*, as shown in FIG. 4. Accordingly, an operator has to guide and press the second and third convolutions 18*b* and 18*c* using his/her fingers, with both ends of the first, second and third convolutions 18*a*, 18*b* and 18*c* to be inserted into the insulator 20 being griped by both bands. Such an operation is very complicate, and if it is not careful, the first, second and third convolutions 18*a*, 18*b* and 18*c* are deformed. At this case, the supporting state of the heater coil 18 gets worse.

DISCLOSURE OF THE INVENTION

Accordingly, the present invention is directed to an insulator for an electric heater that substantially obviates one or more of the problems due to limitations and disadvantages of the related art.

An object of the present invention is to provide an insulator for an electric heater, by which a heater coil can evenly expand and contract over the entire length thereof, and a heater assembly with the same for use in a combined laundry washing/drying machine.

Another object of the present invention is to provide an insulator for an electric heater capable of easily mounting a heater coil, and a heater assembly with the same for use in a combined laundry washing/drying machine.

A further object of the present invention is to provide an insulator for an electric heater capable of preventing a heater coil from being deformed during a mounting process, and a heater assembly with the same for use in a combined laundry washing/drying machine.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided an insulator for an electric heater, the insulator comprising: a body made of electric insulating material; a fixing slot formed at the body for fixing the body to a supporting member; and a coil passing portion formed at the body, through which a heater coil loosely passes and seats.

The coil passing portion is a penetrating hole having an inner diameter larger than an outer diameter of the heater coil, and the coil passing portion has a length longer than a pitch of the heater coil. Preferably, the coil passing portion is two and a half times or three times as long as the pitch of the heater coil.

An edge of the coil passing portion is rounded to prevent the interference between the heater coil and the coil passing portion during expansion and contraction of the heater coil.

According to another aspect of the present invention, there is provided an insulator for an electric heater, the insulator comprising: a body made of electric insulating material; a fixing slot formed at the body for fixing the body to a supporting member; and a coil passing portion formed at an end of the body and inserted into an interior of the heater coil to support the heater coil.

The coil seating portion comprises a convolution supporting surface for contacting with and supporting the heater coil, and the convolution supporting surface has a curvature corresponding to that of the heater coil. The convolution supporting surface has a rounded corner so as to smoothly receive the heater coil.

The coil seating portion is formed in a circular plate, and has a penetrating hole at a center thereof to save material.

The coil seating portion has a thickness thicker than a pitch of the heater coil and thinner than a thickness of the body.

A seating slot is formed between the coil seating portion and body, on which the heater coil is seated. To this end, the seating slot has a curvature corresponding to a curvature of the heater coil. The seating slot has a thickness thinner than a pitch of the heater coil.

The coil seating portion has an inclined surface, a thickness thereof being gradually thinned toward an end of the coil seating portion to facilitate mount of the heater coil.

Accordingly, the heater coil may expand and contract without the interference between the heater coil and the coil passing portion. In addition, heater coil is mounted to the external portion of the coil seating portion through only a insertion process. At that time, it may minimize the deformation of the heater coil.

Furthermore, the present invention provides a combined laundry washing/drying machine employing two types of above-mentioned insulators.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
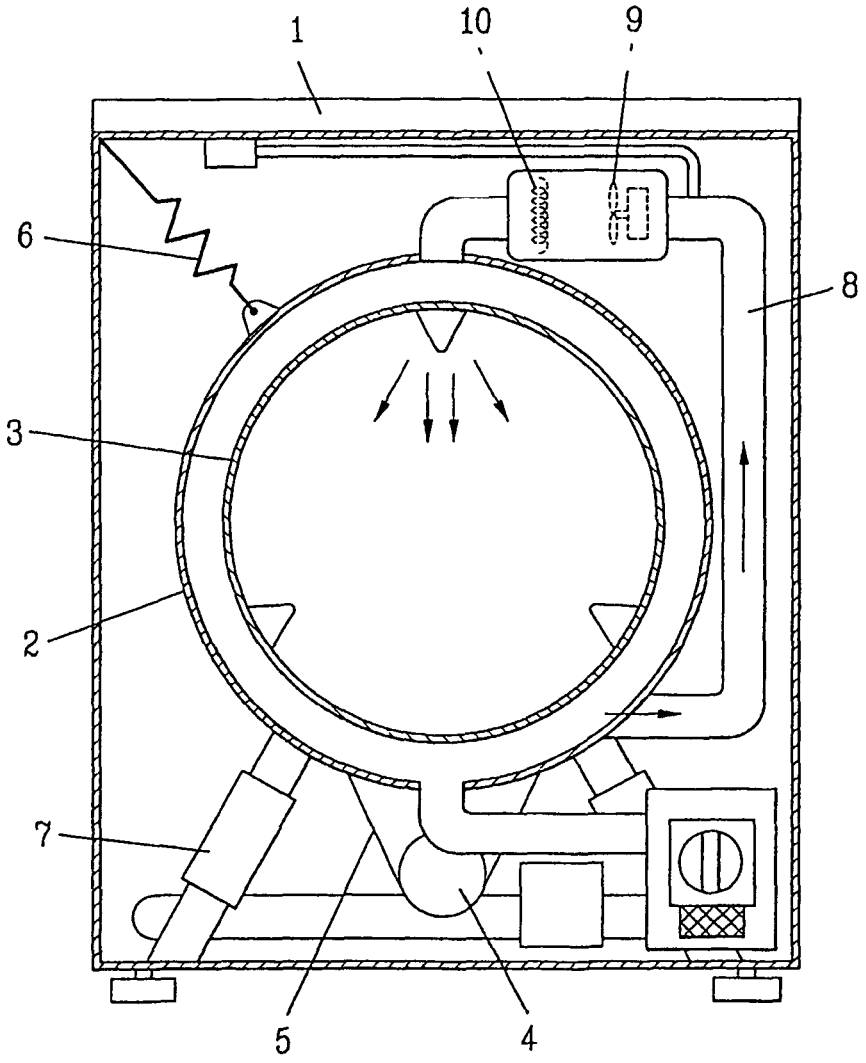
FIG. 1 Related Art
FIG. 1 is a cross sectional view of a conventional combined laundry washing/drying machine.

Reference will now be made in detail to preferred embodiments of the present invention, examples of which are illustrated in the accompanying drawings. In the embodiments, like parts are shown by corresponding reference numerals throughout the drawings, and additive explanation thereof will be omitted.

Figure 5:
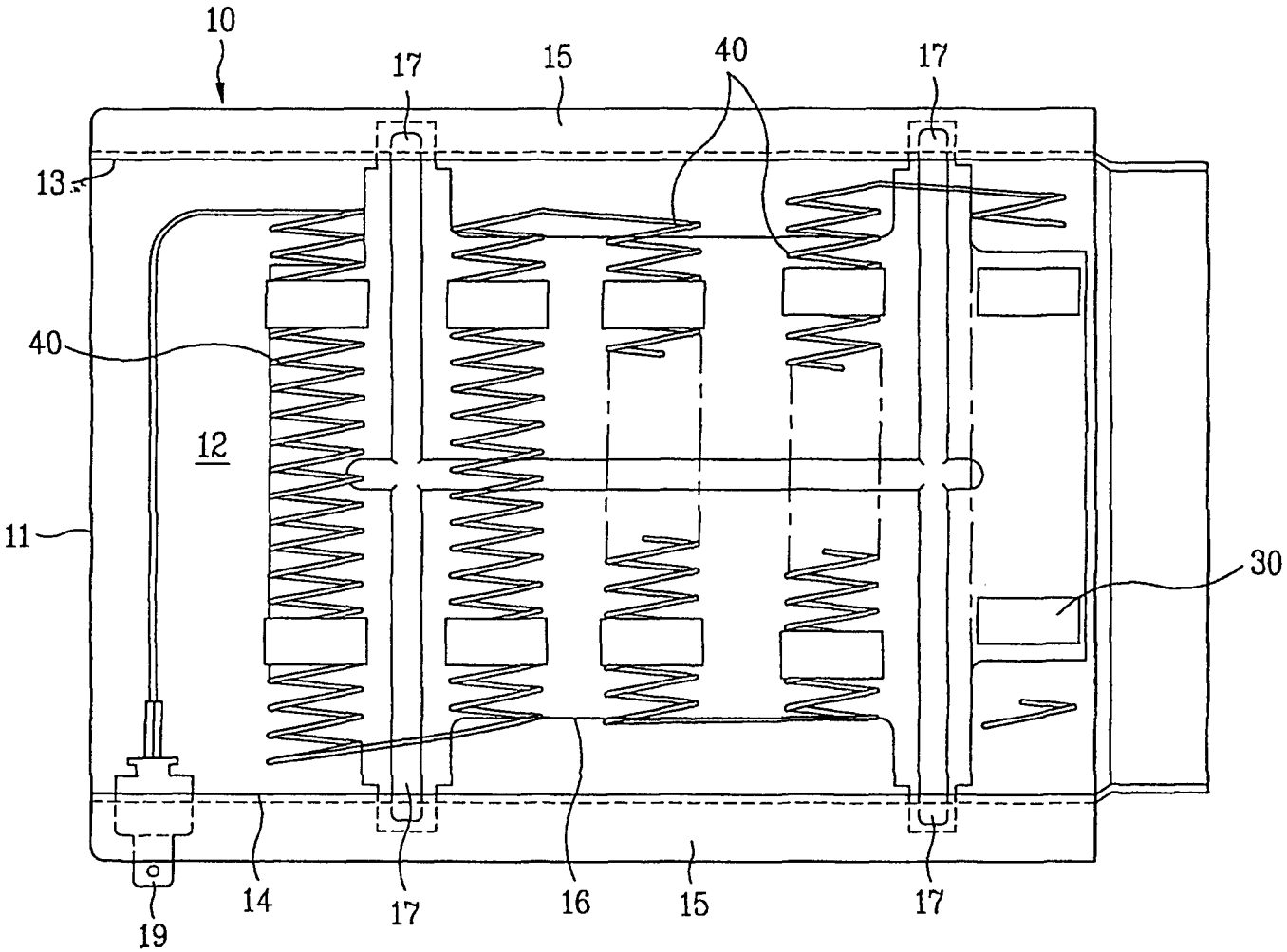
FIG. 5 is a front view of a heater assembly of a combined laundry washing/drying machine according to the present invention.

FIG. 5 is a front view of a heater assembly of a combined laundry washing/drying machine according to the present invention. As shown in FIG. 5, the heater assembly 10 of the present invention includes a housing 11 provided in a blast duct 8 of the combined laundry washing/drying machine shown in FIG. 1, a supporting plate 16 disposed within the housing 11, a heater coil 40 receiving a power for generating heat, and an insulator 30 for supporting the heater coil 40 to electrically isolate the heater coil 40 from the supporting plate 16. The structure of the housing 11, supporting plate 16 and heater coil 40 is similar to that shown in FIG. 2, and thus the detailed description thereof will be omitted.

Figure 2:
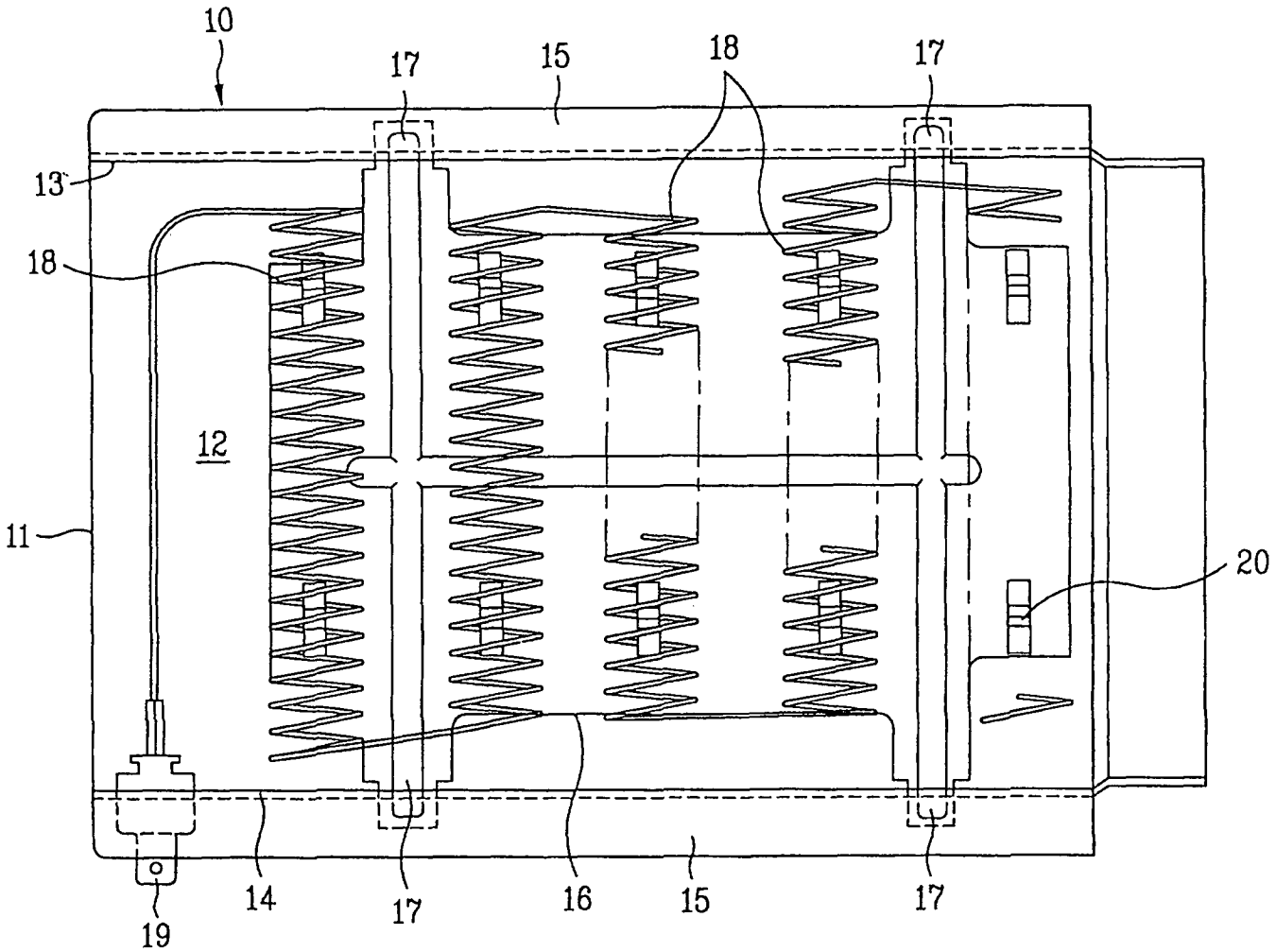
FIG. 2 Related Art
FIG. 2 is a plan view of a conventional heater assembly.
Figure 3:
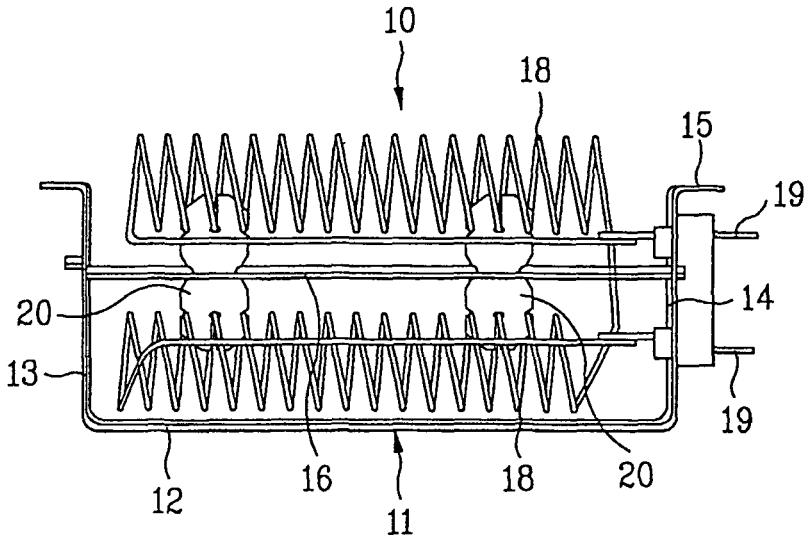
FIG. 3 Related Art
FIG. 3 is a front view of the heater assembly shown in FIG. 2.
Figure 4:
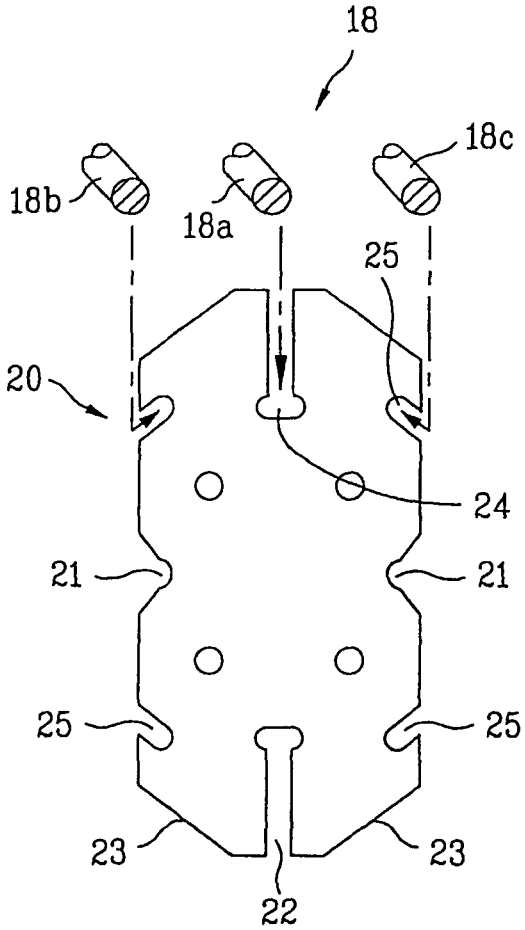
FIG. 4 Related Art
FIG. 4 is a front view of the insulator of the heater assembly shown in FIG. 2.

The manner of mounting the heater coil 40 to the insulator 30 is different from that shown in FIG. 2. Specifically, the insulator 30 is formed in a plate shape, in which the conventional insulator is arranged parallel with a longitudinal direction of the heater coil 40, while the insulator of the present invention is arranged vertical to the longitudinal direction of the heater coil 40. This difference is due to the structure of the insulator 30 of the present invention 30, and embodiments of the insulator will now be described detail.

First Embodiment

Figure 6:
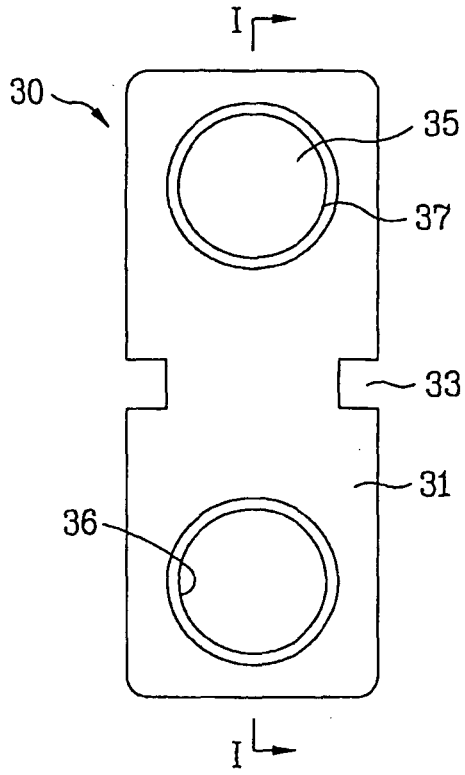
FIG. 6 is a front view of an insulator according to a first preferred embodiment of the present invention.
Figure 7:
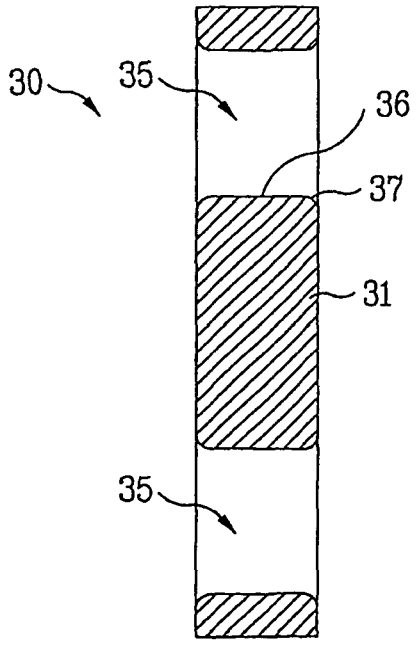
FIG. 7 is a cross sectional view taken along a line I-I of FIG. 6.
Figure 8:
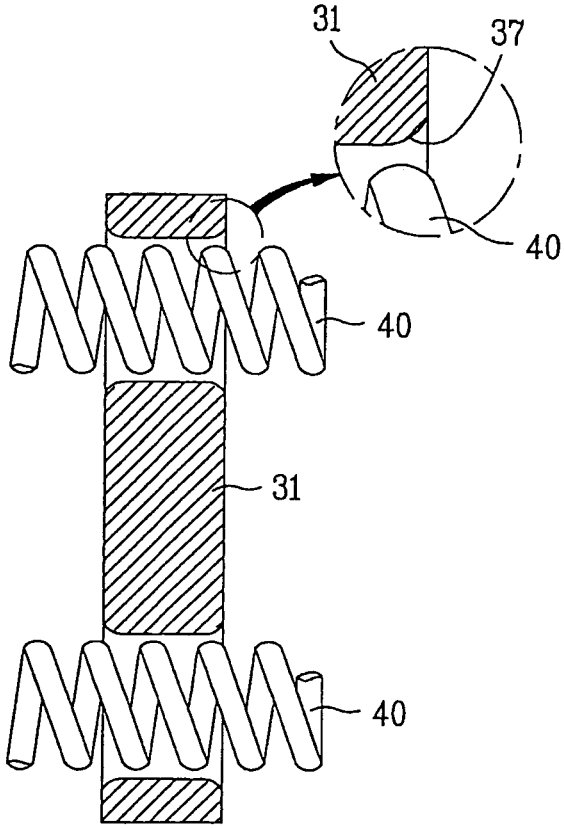
FIG. 8 is a cross sectional view for showing the state in which the heater coil is mounted to the insulator shown in FIG. 6.

FIG. 6 is a front view of an insulator according to a first preferred embodiment of the present invention, FIG. 7 is a cross sectional view taken along a line I-I of FIG. 6, and FIG. 8 is a cross sectional view for showing the state in which the heater coil is mounted to the insulator shown in FIG. 6.

As shown in FIGS. 6 and 7, the insulator according to the first embodiment of the present invention includes a body 31, fixing slots 33 for fixing the body 31 to a supporting plate (indicated by a reference numeral 16 in FIG. 5), and a coil passing portion 35 through which the heater coil (indicated by a reference numeral 40 in FIG. 5) passes.

The body 31 is formed in a flat hexahedral shape extending in one direction, and is made of electrical insulating material. Preferably, the body 31 has a thickness longer than a pitch of the heater coil 40, the reason of which will be described hereinafter. In particular, the body 31 is two and a half times or three times as thick as the pitch of the heater coil 40.

The respective fixing slots 33 is formed at a center of both sides. If the body 31 passes through a hole of the supporting plate 16 and then is rotated at an angle of approximately 90 degrees, the supporting plate 16 is inserted into the fixing slots 33, so that the body 31 is directly secured to the supporting plate 16. The body 31 may be fixed to the supporting plate 16 by additional wire disposed between the fixing slot 33 and the supporting plate 16.

The coil passing portion 35 is a through hole formed in an end of the body 31. The heater coil 40 loosely penetrates through the coil passing portion 35. To this end, the coil passing portion has to have an inner diameter slightly larger than an outer diameter of the heater coil 40. If the heater coil 40 generates the heat, a portion of the heater coil 40 inserted into the coil passing portion 35 may be sufficiently expanded in the same ratio as that of the other portion.

The coil passing portion 35 is provided at an inner periphery thereof with a seating surface 36 having a thickness corresponding to a thickness of the body 31. An outer periphery of the heater coil 40 is directly seated on the seating surface 36. Since the length of the seating surface 36 is longer than the pitch of the heater coil 40, the heater coil 40 can be stably supported on the seating surface 36.

In addition, the coil passing portion 35 is provided at and edge thereof with a divergent rounded surface 37 having a desired curvature. When the heater coil 40 is inserted into the coil passing portion 35, the rounded surface 37 prevents the interference between the heater coil 40 and the coil passing portion 35. In case that the rounded surface 37 is inserted into the coil passing portion 35, the rounded surface 37 prevents the interference between the heater coil 40 and the coil passing portion 35 when the heater coil 40 is repeatedly expanded and contracted.

If the interior space of the housing is divided into upper and lower spaces by the supporting plate 16, the coil passing portion 35 is formed at both ends of the body 31, respectively.

A process of mounting the heater coil to the insulator according to the first embodiment of the present invention will now be described.

As shown in FIG. 5, one heater coil 40 disposed between side walls 13 and 14 of the housing 11 is supported by at least two insulator 30. Specifically, the heater coil 40 is inserted and penetrates through one opening of the coil passing portion 35, and then penetrates through another coil passing portion 35. The heater coil 40 is supported on the seating surfaces 36 of several coil passing portion 35. The state in which the heater coil 40 is supported by optional insulator 30 is fully shown in FIG. 8.

When the heater coil 40 is inserted into the coil passing portion 35, the rounded surface 37 prevents the heater coil 40 from being interfered with the edge of the coil passing portion 35, so that the heater coil 40 is smoothly inserted into the coil passing portion 35. Since the length of the seating surface 36 is longer than the pitch of the heater coil 40, the heater coil 40 can be more stably supported.

Since the inner diameter of the coil passing portion 35 is longer than the outer diameter of the heater coil 40, the heater coil 40 can be expanded within the coil passing portion 35 as much as it can. At that time, a portion of the heater coil 40 may be interfered with the edge of the coil passing portion 35 upon expanding and contracting. This phenomenon is prevented by the rounded surface 37.

According to the first embodiment of the present invention, therefore, the heater coil 40 can evenly expand and contract over the entire length thereof. There is no problem in that the heat stress is concentrated on a particular portion thereof or the heat is nonuniformly distributed over the entire heater coil.

Second Embodiment

Figure 9:
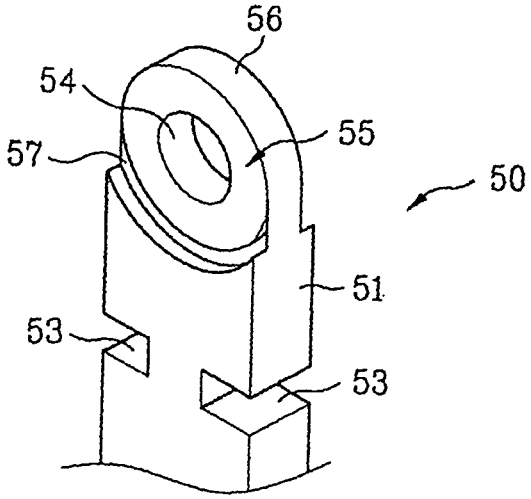
FIG. 9 is a partially perspective view of an insulator according to a second preferred embodiment of the present invention.
Figure 10:
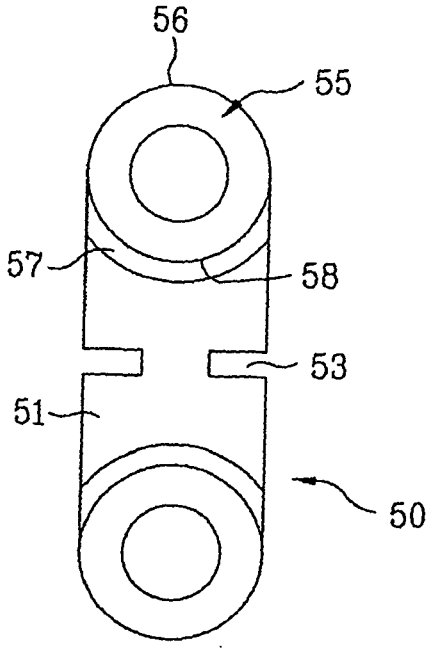
FIG. 10 is a front view of the insulator shown in FIG. 9.
Figure 11:
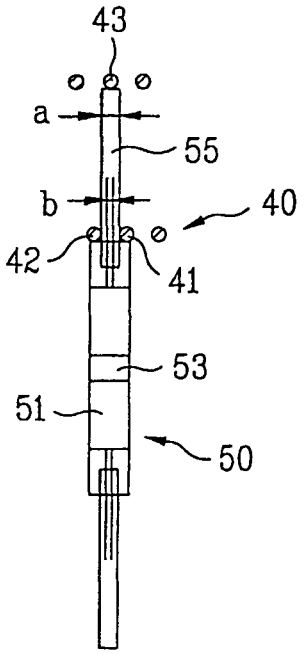
FIG. 11 is a side view of the insulator shown in FIG. 9, to which a heater coil is mounted.
Figure 12:
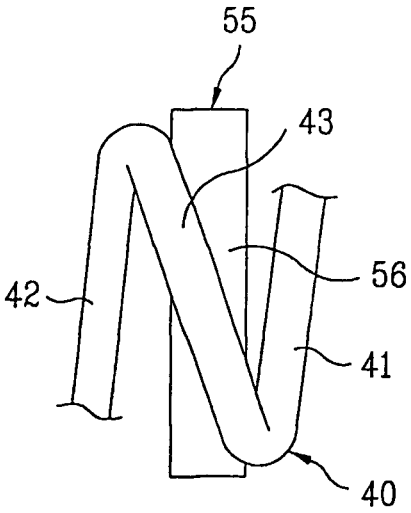
FIG. 12 is a plan view of the insulator shown in FIG. 9, to which a heater coil is mounted.

FIG. 9 is a partially perspective view of an insulator according to a second preferred embodiment of the present invention, FIG. 10 is a front view of the insulator shown in FIG. 9, and FIGS. 11 and 12 are side and plan views of the insulator shown in FIG. 9, to which a heater coil is mounted.

As shown in FIGS. 9 to 11, the insulator according to the second embodiment of the present invention includes a body 51 of a flat-bar shape, fixing slots 53 for fixing the body 51 to the supporting plate (indicated by a reference numeral 16 in FIG. 5), and coil seating portions 55 formed at both ends of the body 51. The body 51 and the coil seating portion 55 are made of electric insulating material such as ceramic.

The respective fixing slots 33 is formed at a center of both sides, the function of which is similar to that of the first embodiment.

The coil seating portion 55 is to be inserted into the interior of the heater coil 40 for supporting the heater coil 40. The coil seating portion 55 is formed in a circular shape, and has a penetrating hole 54 at a center thereof. The penetrating hole 54 is to reduce the consumption of the material used as the insulator 50. Preferably, an outer diameter of the coil seating portion 55 is almost similar to an inner diameter of the heater coil 40, so that the heater coil 40 is resiliently supported.

The coil seating portion 55 is provided on an outer periphery thereof with a convolution supporting surface 56 for supporting convolutions of the heater coil 40. To this end, the convolution supporting surface 56 has a curvature corresponding to that of the heater coil 40. Preferably, the convolution supporting surface 56 has a rounded corner. When the heater coil 40 is mounted to the insulator 50, the heater coil 40 is more easily inserted into the coil seating portion through the rounded corner of the convolution supporting surface 56.

The coil seating portion 55 has a thickness 'a' thicker than the pitch of the heater coil 40. Formation of the coil seating portion 55 to have such a thickness is to prevent the heater coil 40 from being optionally released from the coil seating portion 55. In order to facilitate the insertion of the heater coil into the coil seating portion 55, the thickness 'a' of the coil seating portion 55 is not significantly thick. Preferably, the coil seating portion has to be thinner than the thickness of the body 51.

A seating slot 57 is formed between the coil seating portion 55 and the body 51. The seating slot 57 is to receive a portion of the heater coil 40, and is formed at front and rear surfaces of the body 51, respectively. The seating slot 57 has a curvature corresponding to the curvature of the heater coil 40. The adjacent first and second convolutions 41 and 42 of the heater coil 40 are seated on the coil seating portion 55, with the seating slot 57 being interposed between the convolutions. Preferably, a thickness 'b' between the seating slots 57 is equal to or less than the pitch of the heater coil 40. Since the thickness 'b' of the seating slots 57 is thinner than the thickness 'a' of the coil seating portion 55, a stepped portion is formed therebetween to provide a stopper end 58. The stopper end 58 more rigidly supports the heater coil 40.

The coil seating portion 55 is formed at both ends of the body 51, respectively. In case of supporting the heater coil 40 by use of one side of the supporting plate 16 only, one end of the body may be provided with the coil seating portion 55.

A process of mounting the heater coil to the insulator according to the second embodiment of the present invention will now be described.

For the sake of convenience, as shown in FIG. 12, the portions of the heater coil 40 mounted to the insulator 50 are referred to as a first convolution 41 and a second convolution 42. The intermediate portion connecting the first and second convolutions 41 and 42 is referred to as a connecting portion 43. A distance between the first and second convolutions 41 and 42 is corresponding to the pitch of the heater coil 40.

As shown in FIGS. 11 and 12, the convolution supporting surface 56 is interposed between the first and second convolutions 41 and 42 of the heater coil 40. The heater coil 40 is depressed to insert the coil seating portion 55 into the interior of the heater coil 40.

Since the corner of the convolution supporting surface 56 is rounded, the first and second convolutions 41 and 42 are naturally seated to the coil seating portion 55. At that time, the first and second convolutions 41 and 42 are gradually widened, so that the deformation occurring upon mounting the heater coil 40 may be reduced.

According to further insertion of the heater coil 40, the first and second convolutions 41 and 42 are seated on the seating slot 57. As the results, the first and second convolutions 41 and 42 are disposed along the outer periphery of the coil seating portion 55. At the same time, the connecting portion 43 between the first and second convolutions 41 and 42 is seated on the convolution supporting surface 56. Since the outer diameter of the coil seating portion 55 is corresponding to the inner diameter of the heater coil 40, the heater coil 40 is rigidly supported to the outer periphery of the coil seating portion 55. In particular, since the first and second convolutions 41 and 42 are caught by the stopper end 58, it prevents the release of the heater coil 40.

At that time, since the thickness of the coil seating portion 55 is thicker than the pitch of the heater coil 40, the heater coil 40 is released from the coil seating portion 55 by the resilience thereof, unless the first and second convolutions 41 and 42 are optionally widened.

Third Embodiment

Figure 13:
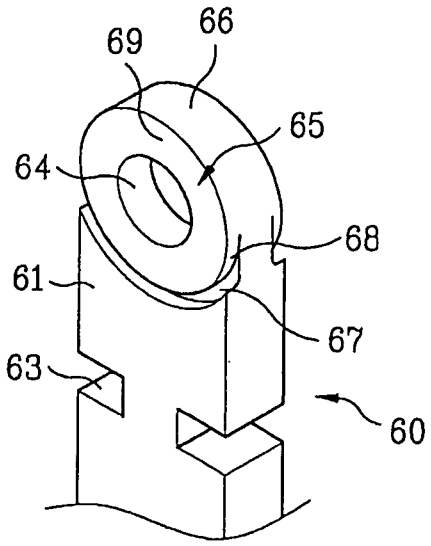
FIG. 13 is a partially perspective view of an insulator according to a third preferred embodiment of the present invention.
Figure 14:
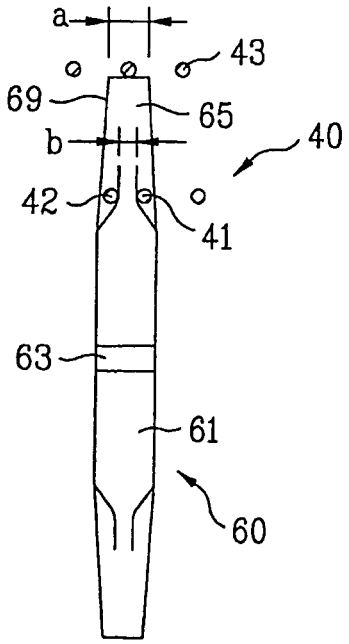
FIG. 14 is a side view of the insulator shown in FIG. 13, to which a heater coil is mounted.

FIG. 13 is a partially perspective view of an insulator according to a third preferred embodiment of the present invention, and FIG. 14 is a side view of the insulator shown in FIG. 13, to which a heater coil is mounted.

As shown in FIG. 13, the insulator 60 according to the third embodiment of the present invention is almost similar to the insulator 50 of the second embodiment of the present invention, except that an inclined surface 69 is further formed at the coil seating portion 65, and has a thickness which is gradually thinned toward an end thereof, so as to minimize the deformation of the heater coil during the mounting process.

Although it is no matter that the inclined surface 69 is formed any one of front and rear surfaces of the coil seating portion 65, it is preferable to form the inclined surface 69 on both surfaces of the coil seating portion. When the heater coil 40 is mounted on the insulator 60, the heater coil 40 is gradually widened along the inclined surface 69. Therefore, the inclined surface to advantageously prevents the deformation of the heater coil during the mounting process thereof.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

With the heater assembly of the present invention, the heater coil loosely penetrates through the coil passing portion. The heater coil freely expands and contracts within the coil passing portion, and it prevents that the heater coil interferences with the coil passing portion by the rounded surface.

Therefore, the heater coil can evenly expand and contract over the entire length thereof. There is no problem in that the heat stress is concentrated on a particular portion thereof or the heat is nonuniformly distributed over the entire heater coil.

In addition, the heater coil is supported along the convolution supporting surface, and simultaneously is inserted into the seating slot, so that it resiliently supports the outer periphery of the coil seating portion. This process is achieved by only pressing the heater coil, thereby easily implementing the mounting operation of the heater coil. Since the inclined surface is formed on the coil seating portion, the heater coil is not deformed during the mounting process. Accordingly, the present invention minimizes the deformation occurring when the heater coil is mounted to the insulator.

What is claimed is:

1. An insulator for an electric heater, the insulator comprising:

a body made of electric insulating material;

a coil seating portion having a first thickness that is uniform throughout the coil seating portion, the coil seating portion supporting a heater coil; and a connection structure having a second thickness, the connection structure being between the body and the coil seating portion wherein a difference between the first thickness and the second thickness forms a seating slot where the heater coil sits on the seating slot and the coil seating portion.

2. The insulator as claimed in claim 1, wherein the coil seating portion is formed at both longitudinal ends of the body, respectively.

3. An insulator for an electric heater, the insulator comprising:

a body made of electric insulating material;

a coil seating portion having a top portion, a bottom portion and a first thickness, wherein the bottom portion connects to an end of the body and the coil seating portion is inserted into an interior of a heater coil to support the heater coil; and a connection structure having a second thickness, the connection structure being between the body and the coil seating portion wherein a difference between the first thickness and the second thickness forms a seating slot where the heater coil sits on the seating slot and the top portion of the coil seating portion.

4. The insulator as claimed in claim 3, wherein the top portion of the coil seating portion comprises a convolution supporting surface for contacting with and supporting the heater coil, and the convolution supporting surface has a curvature corresponding to that of the heater coil.

5. The insulator as claimed in claim 4, wherein the coil seating portion is formed in a circular shape, and has a penetrating hole at a center thereof.

6. The insulator as claimed in claim 4, wherein the convolution supporting surface has a rounded corner.

7. The insulator as claimed in claim 3, wherein the first thickness of the coil seating portion is thicker than a pitch of the heater coil and thinner than a thickness of the body.

8. The insulator as claimed in claim 3, wherein the seating slot has a curvature corresponding to a curvature of the heater coil.

9. The insulator as claimed in claim 3, wherein the seating slot has a thickness thinner than a pitch of the heater coil.

10. The insulator as claimed in claim 3, wherein the coil seating portion has an inclined surface, a thickness thereof being gradually thinned toward an end of the coil seating portion to facilitate mounting of the heater coil.

11. The insulator as claimed in claim 3, wherein the coil seating portion is formed at both longitudinal ends of the body, respectively.

12. A heater assembly of a combined laundry washing/drying machine, the heater assembly comprising:

a housing for providing an air passage communicating with a tub accommodating laundry to be dried;

a supporting plate disposed in an interior of the housing;

a heater coil supported by the supporting plate for generating heat, the heater coil being electrically isolated from the supporting plate; and an insulator including a body made of electric insulating material, a fixing slot formed at the body for fixing the body to the supporting plate, a coil seating portion having a top portion, a bottom portion and first thickness, wherein the bottom portion connects the body, the coil seating portion supporting a heater coil and a connection structure having a second thickness, the connection structure being between the body and the coil seating portion wherein a difference between the first thickness and the second thickness forms a seating slot where the heater coil sits on the seating slot and the coil seating portion.

13. The heater assembly as claimed in claim 12, wherein the supporting plate divides an inner space of the housing into upper and lower portions.

14. The heater assembly as claimed in claim 13, wherein the coil seating portion is formed at both longitudinal ends of the body, respectively.

15. A heater assembly of a combined laundry washing/drying machine, the heater assembly comprising:

a housing for providing an air passage communicating with a tub accommodating laundry to be dried;

a supporting plate disposed in an interior of the housing;

a heater coil supported by the supporting plate for generating heat, the heater coil being electrically isolated from the supporting plate; and an insulator including a body made of electric insulating material, a fixing slot formed at the body for fixing the body to a supporting member, a coil seating portion having a top portion, a bottom portion and a first thickness, wherein the bottom portion connects to an end of the body and the coil seating portion is inserted into an interior of the heater coil to support the heater coil and a connection structure having a second thickness, the connection structure being between the body and the coil seating portion wherein a difference between the first thickness and the second thickness forms a seating slot where the heater coil sits on the seating slot and the top portion of the coil seating portion.

16. The heater assembly as claimed in claim 15, wherein the top portion of the coil seating portion comprises a convolution supporting surface for contacting with and supporting the heater coil, and the convolution supporting surface has a curvature corresponding to that of the heater coil.

17. The heater assembly as claimed in claim 16, wherein the coil seating portion is formed in a circular plate, and has a penetrating hole at a center thereof.

18. The heater assembly as claimed in claim 16, wherein the convolution supporting surface has a rounded corner.

19. The heater assembly as claimed in claim 15, wherein the first thickness of the coil seating portion is thicker than a pitch of the heater coil and thinner than a thickness of the body.

20. The heater assembly as claimed in claim 15, wherein the seating slot has a thickness thinner than a pitch of the heater coil.

21. The heater assembly as claimed in claim 15, wherein the coil seating portion has an inclined surface, a thickness thereof being gradually thinned toward an end of the coil seating portion to facilitate mount of the heater coil.

22. The heater assembly as claimed in claim 15, wherein the supporting plate divides an inner space of the housing into upper and lower portions.

23. The heater assembly as claimed in claim 22, wherein the coil passing portion is formed at both longitudinal ends of the body, respectively.

24. A clothes washer insulator comprising:

a body made of electric insulating material;

a fixing slot formed at the body for fixing the body to a supporting member; and a coil seating portion having a top portion, a bottom portion and first thickness, the bottom portion connected to the body, the coil seating portion supporting a heater coil; and a connection structure having a second thickness, the connection structure being between the body and the coil seating portion wherein a difference between the first thickness and the second thickness forms a seating slot where the heater coil sits on the seating slot and the top portion of the coil seating portion.

25. The clothes washer insulator as claimed in claim 24, wherein the coil passing portion is formed at both longitudinal ends of the body, respectively.

26. An insulator for an electric heater, the insulator comprising:

a body made of electric insulating material;

a fixing slot formed at the body for fixing the body to a supporting member;

a coil seating portion having a top portion, a bottom portion and a first thickness, the bottom portion connected to the body, the coil seating portion supporting a heater coil; and a connection structure having a second thickness, the connection structure being between the body and the coil seating portion wherein a difference between the first thickness and the second thickness forms a seating slot where the heater coil sits on the seating slot and the top portion of the coil seating portion.

27. The insulator as claimed in claim 26, wherein the coil seating portion is formed at both longitudinal ends of the body, respectively.

28. The insulator as claimed in claim 26, wherein the fixing slot is configured to allow the body to latch on the supporting member.

29. The insulator as claimed in claim 1, wherein the difference between the first thickness and the second thickness forms a second seating slot.

30. The insulator as claimed in claim 3, wherein the difference between the first thickness and the second thickness forms a second seating slot.

31. The heater assembly as claimed in claim 12, wherein the difference between the first thickness and the second thickness forms a second seating slot.

32. The heater assembly as claimed in claim 15, wherein the difference between the first thickness and the second thickness forms a second seating slot.

33. The clothes washer insulator as claimed in claim 24, wherein the difference between the first thickness and the second thickness forms a second seating slot.

34. The insulator as claimed in claim 26, wherein the difference between the first thickness and the second thickness forms a second seating slot.

35. The insulator as claimed in claim 1, wherein the second thickness is less than the first thickness.

36. The insulator as claimed in claim 3, wherein the first thickness of the coil seating portion is uniform.

37. The insulator as claimed in claim 3, wherein the first thickness is less than the second thickness.

* * * * *